United States Patent [19]

Levy et al.

[11] Patent Number: 4,850,292

[45] Date of Patent: Jul. 25, 1989

[54] SHIRT PLACKET CONSTRUCTOR AND AUTOMATIC FINISH STITCH BOXER

[76] Inventors: Michael Levy, 1225 Village Green Dr.; John P. Shoemate, 1301 Mayfield Ln., both of Hixson, Tenn. 37343

[21] Appl. No.: 16,116

[22] Filed: Feb. 18, 1987

[51] Int. Cl.[4] ..... D05B 21/00; D05B 3/02

[52] U.S. Cl. ..... 112/121.12; 112/121.15; 112/104

[58] Field of Search ..... 112/65, 121.12, 121.15, 112/217, 104; 2/131

[56] References Cited

U.S. PATENT DOCUMENTS

| | | | |
|---|---|---|---|
| 2,639,433 | 5/1953 | Liebowitz | 2/131 |
| 3,517,630 | 7/1968 | Bennison et al. . | |
| 3,693,191 | 9/1972 | Dowsett | 2/131 |
| 3,747,544 | 7/1973 | Nicolay et al. | 112/65 |
| 3,980,030 | 9/1976 | Fischer et al. | 112/65 X |
| 4,114,545 | 9/1978 | Manabe et al. . | |
| 4,132,183 | 1/1979 | Kienel . | |
| 4,186,673 | 2/1980 | Vartoukian . | |
| 4,261,272 | 4/1981 | Duescher | 112/217 |
| 4,406,234 | 9/1983 | Johnson et al. . | |
| 4,493,276 | 1/1985 | Sadeh . | |
| 4,498,404 | 2/1985 | Sadeh . | |
| 4,512,269 | 4/1985 | Bowditch . | |
| 4,517,907 | 5/1985 | Franke, Sr. . | |
| 4,590,872 | 5/1986 | Bray . | |

*Primary Examiner*—H. Hampton Hunter

*Attorney, Agent, or Firm*—Irving M. Weiner; Joseph P. Carrier; Robert M. Petrik

[57] ABSTRACT

A system for folding and fusing limp strips of fabric to form a semi-finished placket and for assembly of the placket together with an unfinished shirt. The system comprises a folder apparatus, a fuser apparatus, and a sewer apparatus capable of applying the requisite reversed "L"-shaped pattern to the semi-finished placket-unfinished shirt combination.

18 Claims, 3 Drawing Sheets

Fig. 6
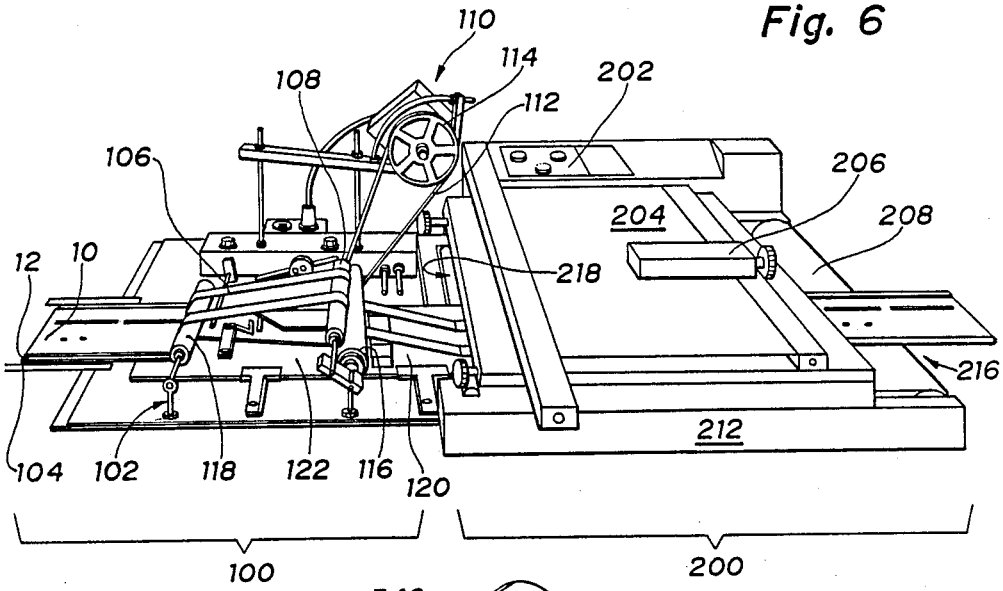
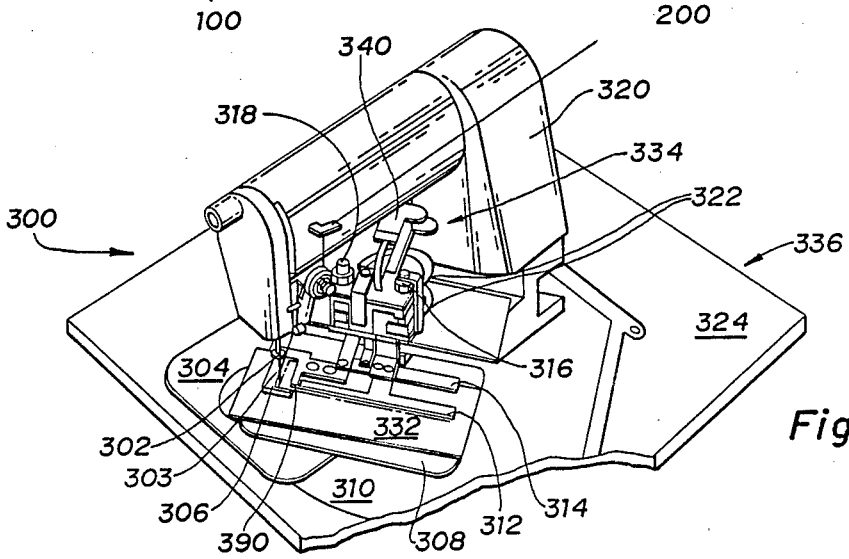
Fig. 7
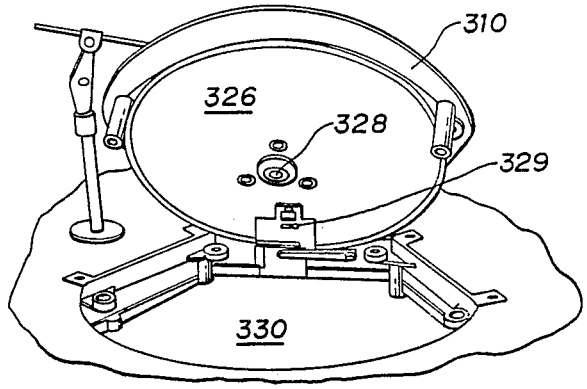
Fig. 8

SHIRT PLACKET CONSTRUCTOR AND AUTOMATIC FINISH STITCH BOXER

BACKGROUND OF THE INVENTION

1. Field of the Invention

The present invention relates generally to the construction of shirt plackets and automatic finish stitching and boxing of the same onto a shirt. More particularly, the invention relates to the construction of semi-finished shirt plackets through a convenient and efficient combination of devices and steps and to the finish stitching and boxing of an unfinished shirt having the placket affixed thereto to produce a more complete sport shirt.

2. Description of the Relevant Art

The relevant art is exemplified by: Bennison et al. U.S. Pat. No. 3,517,630 entitled "STITCHING OF MATERIALS"; Manabe et al. U.S. Pat. No. 4,114,545 entitled "AUTOMATIC SEWING MACHINES"; Kienel U.S. Pat. No. 4,132,183 entitled "METHOD AND APPARATUS FOR SEAMING HOSIERY BLANKS"; Vartoukian U.S. Pat. No. 4,186,673 entitled "MATERIAL FEED MECHANISM FOR SEWING MACHINES"; Smith et al. U.S. Pat. No. 4,324,004 entitled "METHOD FOR MAKING FUSED COLLARS AND PRODUCT RESULTING THEREFROM"; Johnson et al. U.S. Pat. No. 4,406,234 entitled "POSITIONING APPARATUS"; Sadeh U.S. Pat. No. 4,493,276 entitled "POCKET SETTER UNIT AND AUTOMATIC SEWING MACHINE INCLUDING SAME"; Sadeh U.S. Pat. No. 4,498,404 entitled "AUTOMATIC SEWING APPARATUS"; Bowditch U.S. Pat. No. 4,512,269 entitled "AUTOMATED ASSEMBLY SYSTEM FOR SEAMED ARTICLES"; Franke, Sr. U.S. Pat. No. 4,517,907 entitled "DRIVEN WORK FOLDER"; and Bray U.S. Pat. No. 4,590,872 entitled "AUTOMATIC LABEL EMPLACER AND DISPENSER FOR SEWING MACHINES".

The present invention includes features which are not taught or suggested by the relevant art. These features provide a unified system for preparing a placket product, fastening it to an unfinished shirt body, and finishing the shirt with an automatic finish stitcher and boxer apparatus which finish stitches the placket product to the shirt body with an appropriate stitch pattern, such as a reversed "L"-shaped box pattern which is conventionally used in the art.

SUMMARY OF THE INVENTION

The present invention provides a system and method for joining and finishing two overlapping strips of limp fabric which, when joined and finished, form a semi-finished shirt placket and attaching said placket to an unfinished shirt. The system comprises a folder means for folding a pair of edges of the overlapping strips of fabric along predetermined fold lines, a fuser means for fusing the strips and the folded edges together, and a sewer means for sewing the requisite reversed "L"-shaped pattern on the front of the shirt. While the folder means and the fuser means are actually independent devices, they are related to one another in such a manner that a folded placket is delivered directly into the fuser means from the folder means to prevent unfolding.

The semi-finished placket is then introduced onto an unfinished shirt, and the two are sewn together by conventional commercial means at particular spots. After a series of maneuvers accomplished by hand and/or conventional mechanical means, the semi-finished placket-unfinished shirt combination is placed onto a special sewer unit with which the reversed "L"-shaped pattern is applied to securely affix the two portions together.

An object of the present invention is to provide a unified system which is efficient and easy to use for constructing a semi-finished shirt placket and automatically finish stitching and boxing an unfinished shirt and semi-finished placket assembly.

Another object of the invention is to provide such a system which minimizes operating cost.

A further object of the invention is to provide such a system and method which eliminates the process of applying the reversed "L"-shaped box pattern by hand as is commonly done presently.

Yet another object of the invention is to provide such a system and method which minimizes manual labor.

A further object of the present invention is to provide such a system and method which provides a product of consistently high quality.

Still another object of the present invention is to provide a built-in material guide onto a stitcher used in combination with other finished product producing devices.

Yet a further object of the present invention is to provide an automated stitcher used in combination with other devices which is neither hand held nor operator guided.

Another object of the present invention is to provide such a stitcher which can be readily adapted to existing sewing machine units.

A further object of the present invention is to provide such a stitcher capable of varying the size and shape of the stitch pattern.

Still a further object of the present invention is to provide such a stitcher which is easily serviced.

And yet still another object of the present invention is to provide a stitcher used in combination with other devices which eliminates the wavering of a seam.

To the accomplishment of these and related objects which shall become apparent as the description proceeds, the present invention resides in the construction, combination and arrangement of parts as shall be hereinafter more fully described, illustrated in the accompanying drawings, and pointed out in the appended claims.

BRIEF DESCRIPTION OF THE DRAWINGS

FIG. 6 illustrates a perspective view of the folder and fuser apparatus according the present invention.

FIG. 7 illustrates a perspective view of a sewer apparatus according to the present invention.

FIG. 8 illustrates a tilted-open perspective view of the sewer apparatus as shown in FIG. 7.

DETAILED DESCRIPTION OF THE PREFERRED EMBODIMENTS

With reference to FIGS. 1–9 there is described the preferred product, selected elements thereof, and the apparatus of the invention.

Figure 1:
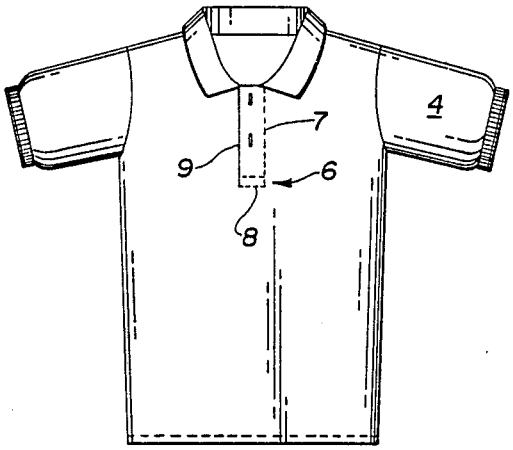
FIG. 1 illustrates a front view of a finished shirt indicating the relative position of the finished placket and its requisite pattern according to the present invention.

With respect to the preferred product, FIG. 1 shows a shirt and the position of the finished placket and the requisite pattern relative thereto. While the shirt shown is a sport shirt, applicant notes that a variety of styles of shirts may be produced according to the present invention. The illustrated style of shirt has been chosen by way of convenient example.

Figure 4:
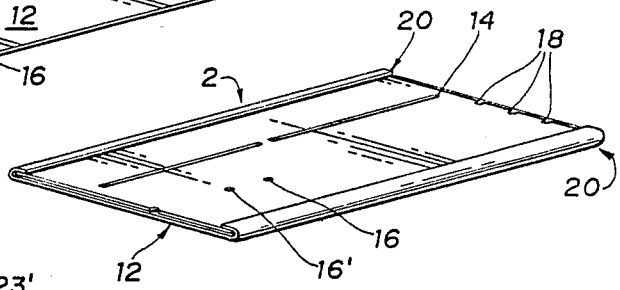
FIG. 4 illustrates a perspective view of the lining and the limp strip of fabric of FIG. 3 fused together with folded edges, forming a placket.

The semi-finished placket, generally indicated as 2 in FIG. 4, is a result of folding and fusing two limp strips of fabric by means of the folder and fuser of FIG. 6, more fully described below. The semi-finished placket 2 is incorporated into an unfinished shirt and, by a unique pattern and a plurality of intermediate steps is fixedly combined therewith.

Returning now to FIG. 2, there is shown an unfinished shirt front 5 having positioned thereon semi-finished placket 2.

Figure 3:
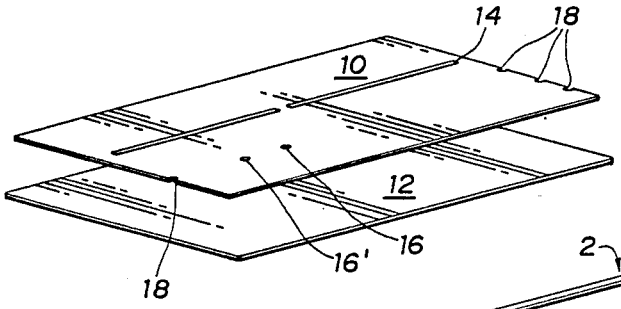
FIG. 3 illustrates a perspective view of a lining and a limp strip of fabric utilized in the construction of a placket according to the present invention.

The semi-finished placket 2 is actually comprised of two independent pieces folded and fused together. The steps for creating semi-finished placket 2 are illustrated in FIGS. 3–4. As shown, the pieces are of a general rectangular shape, but may be of varying dimensions as need requires. Referring now to FIG. 3, there is shown two pieces, a heat-sensitive adhesive lining 10 and an outer finished material 12. The lining 10 is die-cut so that its exact configurations are consistently achieved. The lining 10 has die-cut therein a plurality of longitudinal slits, holes and notches. These cuttings conveniently provide positions for folding (along longitudinal slits) and for denoting setting points (at the notches) and sewing and cutting stopping points (the plurality of holes). According to the preferred embodiment, there are shown two longitudinal slits 14, stopping holes 16, 16' and marking notches 18.

Referring now to FIG. 4, there is shown lining 10 in place upon outer finished material 12. Once in place, the excess material of material 12 is folded over the edges of lining 10 along two longitudinal folds generally indicated by 20. In accordance with the invention, folding is accomplished by an automatic folder as shown in FIG. 6 and generally indicated by 100. The two strips of material, so folded, are then fused together, preferably with the application of heat, although it is envisioned that such fusing may be accomplished by alternate methods. According to the preferred embodiment, fusing is accomplished mechanically by means of a fuser as shown in FIG. 6 and as generally indicated by 200.

The step of folding briefly described above with respect to FIGS. 3–4 is accomplished automatically to assure consistency and efficiency. Referring now to FIG. 6, in general operation, folder 100 receives at one end two strips of limp fabric, unfolded, and, by a system of belts and a plurality of folding guide bars, produces a folded product. According to the preferred embodiment, there is shown a support member 102 generally supporting a feed plate 104 which intakes the overlaid lining 10 and material 12. When lining 10 and material 12 are abutted against guide belts 106 which ride upon receiving belt roller 118, intermediate belt roller 108 and are driven by drive roller 116, lining 10 and material 12 are guided into the folder and beneath folder plate 122. Drive roller 116 itself is driven via drive belt 112 and drive pulley 114 by drive motor 110.

Once inside the folder, through a series of folder guides and bars (not shown), the longitudinal edges of material 12 are folded over lining 10. The folded product is delivered from the folder via transfer plate 120. Since the folds accomplished by the folder would readily unfold if downward pressure was removed from the product, the preferred embodiment of this invention provides for transfer of the folded product directly into the intake of fuser 200.

As discussed, fusing may be accomplished by heat-fusing the lining to the material, or by other means, e.g., by providing a lining which has an adhesive which does not require heat for fusing. According to the preferred embodiment, however, the preferred method of fusing is the application of heat sensitive adhesive lining material. The heat applying function is embodied in fuser 200. The fuser 200 preferably has an internal heating element (not shown) and a means of transferring the folded placket through the fuser. According to the preferred embodiment, there is an inlet generally indicated by 218 and fuser placket outlet generally indicated by 216. As provided, inlet 218 abuts transfer plate 120 of folder 100 so that the folded placket may be drawn immediately, as folded, into the fuser. Accordingly, the placket will not become unfolded before becoming fused.

The placket, once delivered to inlet 218, is carried through the fuser via placket guide belt 208. While carried through fuser 200, the placket receives both heat from the internal heating element and downward pressure by a pressure means (not shown). Pressure is controlled by pressure adjuster 206 which is fixed upon cover portion 204, which in turn rests upon base portion 212. The fuser 200 is preferably controlled by a control panel. According to the preferred embodiment, this panel is indicated by control panel 202.

Once folded and fused, the semi-finished placket is attached and manipulated through a multi-stepped process to produce a semi-finished placket-unfinished shirt combination. This process is more fully described below.

Referring now to FIG. 7, the prepared semi-finished placket-unfinished shirt combination receives the closing reversed "L"-shaped box pattern on a sewer generally indicated by 300. Preferably, but not exclusively, sewer 300 is comprised of four basic elements: A conventional sewer unit, generally indicated by 320, a base, generally indicated by 336, a movable sewer assembly, generally indicated by 334, and a channeled flywheel 326 (illustrated in FIG. 8).

Still referring to FIG. 7, according to the preferred embodiment, the converted sewer unit 320 is motor driven and has a needle holder 302 and a needle 303 held therein. There is also provided a fixed plate 304 for receiving material. While conventional sewing machines have as standard equipment fixed plates, they are normally smaller, and do not meet the needs of the present invention. Accordingly, fixed plate 304 is uniquely designed and may be accommodated by a variety of conventional sewing machines. Suggested conventional units for application of this invention are the Singer (trademark) Model 269 and the Union Special (trademark) Model P260, although other brands and models are convertible for use according to the preferred embodiment.

The base 336 is preferably, but not exclusively, comprised of a baseboard 324 and hinged flywheel cover 310. The hinged cover 310, in addition to providing main support for sewer 320, may be lifted at its front (the needle end of the machine) and tilted backward, such motion allowed for by the hinge. Such tilting results the open view shown in FIG. 8. According to the view illustrated in FIG. 8, one of the four basic components of the device, channelled flywheel 326 is exposed. While this view only allows the smooth outer side of flywheel 326 to be seen, the apparatus also provides that on the internal side of the flywheel there is provided a plurality of interrelated channels or guide means. Communicating with the channels or guide means is one end of a drive arm (not shown) which, at its other end, through a series of linkages (preferably, but not exclusively, ball and joint linkages), is pivotally fitted to the movable pattern sewer assembly 334 illustrated in FIG. 7. As the flywheel rotates on its axis (located approximately at axis bolt 328), the drive arm is moved according to the fixed pattern of the channel or guide means and moves, according to its predetermined course, movable assembly 334 to accommodate moving the object being sewn with respect to needle 303.

Figure 9:
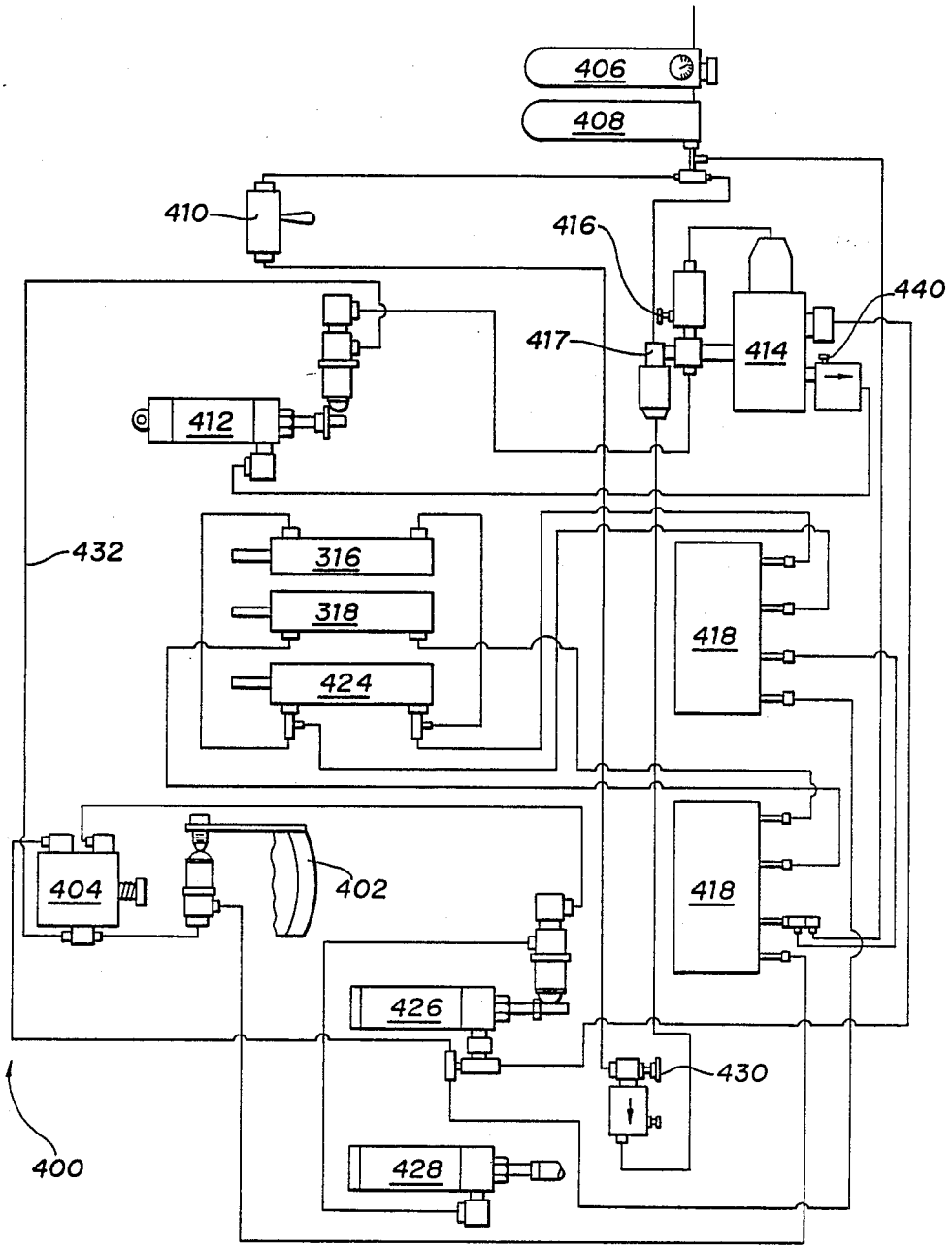
FIG. 9 illustrates a sewer apparatus schematic in accordance with the present invention.

Referring again to FIG. 8, the thread provided for the sewing process is selectively cut by thread cutter 329 which is driven by a selected fluid as part of the fluid drive system (see FIG. 9). Returning the unit to its operating position (as shown in FIG. 7), flywheel 326 and the associated mechanisms fit within the confines of flywheel well 330.

Referring back to FIG. 7, preferably, but not exclusively, movable sewer assembly 334 is axially mounted to sewer unit 320 in relation to needle 303 and needle holder 302. The assembly 334 is comprised of a plurality of fluid driven "feet" which are selectively pressed upon a movable template, selectively securing the material being sewn therebetween. The "feet" and their associated plurality of fluid cylinder units are fixed to an upper end of a movable arm 340 which itself is axially fitted to flywheel cover 310.

According to the preferred embodiment, "three feet" are selectively employed, including a slave pressure foot 314, a box pressure foot 306, and a straight pressure foot 312. These feet are controlled by a plurality of fluid driven cylinder units. According to the preferred embodiment, there is one cylinder for each of the three "feet", a slave pressure foot cylinder unit (not shown), a box pressure foot cylinder unit 318 and straight pressure foot cylinder unit 316. Fluid lines are fitted to each cylinder unit as shown by way of example by fluid lines 322.

There is also provided a template upon which the article to be sewn is placed. According to the preferred embodiment, this template is defined as movable template 308 which is fitted to the lower portion of movable arm 340 and is movably positioned beneath needle holder 302.

Cut into the movable template 308 is the shape of the preferred reversed "L"-shaped box pattern.

As noted above, the system operates preferably but not exclusively, by means of a fluid system. While a variety of fluids are workable, the fluid preferred for use according to the disclosed embodiment is air.

While a variety of combinations of fluid system elements and fluid lines may be associated to result in a fluid control system for the sewer 300, according to the preferred embodiment there is provided an operating system 400 as shown in FIG. 9. Referring now thereto, the system elements are interconnected by a plurality of fluid lines 432. The system is filtered and regulated by filter-regulator 406 and is lubricated by lubricator 408. The system is further regulated at appropriate subsystems by regulators 416, 440 and 430 so as to provide usable fluid pressure. Four-way control valve 414, three-way control valve 417, control units 418 and toggle valve 410 provide necessary selective fluid activation of the working elements of the system. These working elements include start cylinder 428 which engages channelled flywheel 326 (see FIG. 8), slave pressure foot cylinder unit 424, which activates slave pressure foot 314 (see FIG. 7), box pressure foot cylinder unit 318 which activates box pressure foot 306 (see FIG. 7), and straight pressure foot cylinder unit 316 which activates straight pressure foot 312 (see FIG. 7).

Other working elements illustrated in FIG. 9 include lift cylinder 426 which controls thread cutter 329 (see FIG. 8) and shift cylinder 412 which is operated lastly to return movable assembly 334 (see FIG. 7) to its cycle starting position. As shown, an operator will preferably control the system by means of pedal 402 (shown in cut-away) and interconnected foot control valve 404.

In operation, the system according to the preferred embodiment characterizes preferably, but not exclusively, a number of defined steps, some of which have been discussed briefly already above.

According to the preferred embodiment, the operator die-cuts from two respective dies two strips, heat-sensitive adhesive lining 10 and outer finished material 12, which are then overlaid, leaving excess material 12 extending beyond each longitudinal edge of lining 10. The overlaid pieces are placed, material side down, onto feed plate 104 of folder 100 (FIG. 6). As the overlaid pieces are drawn into and through folder 100 by means of guide belts 106, the excess material edges are folded over the adhesive coated lining. The pieces so folded are carried directly into inlet 218 of fuser 200 via transfer plate 120. Once in fuser 200, the two pieces are fused together according to the mechanism described above, and are carried through and out of fuser 200 by means of placket guide belt 208, resulting in a folded and fused placket delivered from outlet 216.

Once folded and fused, attachment of the semi-finished placket to the unfinished shirt front and the finishing thereof is accomplished by a multi-stepped process. According to the present invention, the process incorporates several steps, although it is envisioned that additional steps may be added or modified, and some steps may even be deleted.

First, referring back to FIG. 2, semi-finished placket 2 is positioned as shown, lining side out, and is sewn to the outer (finished) side of unfinished shirt front 5. A stitched double line indicated by stitches 3, 3' is used to preliminarily fix placket 2 to shirt front 5. The stitched double line extends from the top of placket 2 until approximately mid-way between stopping holes 16, 16'. A conventional double stitch needle sewing machine is employed for this step of the process.

Figure 2:
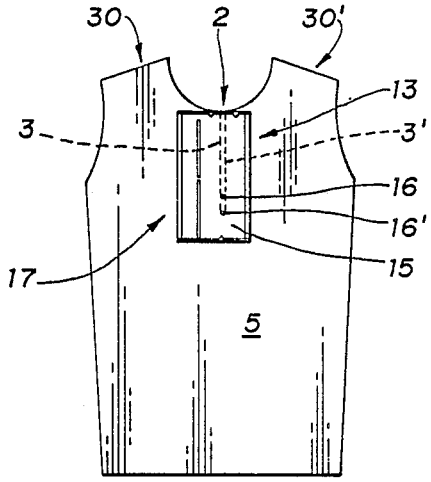
FIG. 2 illustrates a front view of an unfinished shirt with the placket sewn in place and ready for additional cutting and sewing operations according to the present invention.

Second, and still referring to FIG. 2, one side of placket 2, the wider placket half generally indicated by 17, is folded over at stitch 3. Thereafter, another stitch line is applied to the folded-over placket (not shown) approximately mid-way between and about the length of stitches 3, 3'. This stitched line is applied by means of a conventional sewing machine.

Third, the overfolded placket is unfolded by hand, leaving the last padded stitch line intact, and conventional scissors or other cutting means are used to cut placket 2 and its now associated shirt front 5 between stitches 3, 3'. The material is cut from the top of placket 2 to approximately mid-way between stopping holes 16, 16'. A bridge between the two "halves" is left, as generally indicated by 15 in FIG. 2.

Figure 5:
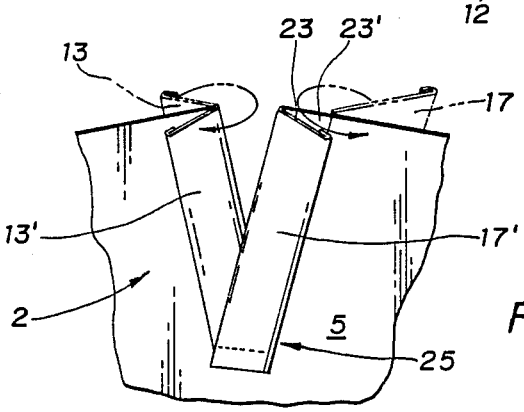
FIG. 5 illustrates a detailed perspective view revealing the back side of the placket and shirt front combination of FIG. 2 after having been cut, and indicating the folding procedure required toward preparation of a finished shirt according to the present invention.

Fourth, referring now to FIG. 5, there is shown the inner side of unfinished shirt front 5. The "halves" of placket 2 are shown in two positions. The first position illustrates wider placket half 17 and narrower placket half 13 as they appear relative to the viewer of the inner side of shirt front 5 after having been cut according to the third step of this process described above. The second position indicates narrower placket half 13' having been turned in toward the back side of shirt front 5 and wider placket half 17' having been turned in and folded along longitudinal slits 14 (see FIGS. 3–4). After folded over along slits 14, the inner lining sides 23, 23' face one another. The front side of wider placket half 17' will eventually be fitted with buttons.

Fifth, again referring to FIG. 5, a single horizontal stitch 25 is applied by conventional means to close the lower portion of semi-finished placket 2.

Sixth, referring now to FIG. 2, an unfinished shirt back (not shown) is sewn by conventional means to shirt front 5 at shoulder joint positions 30, 30'.

Seventh, a shirt collar portion (not shown) is fitted.

Eighth, referring now to FIG. 7, the semi-finished placket-unfinished shirt combination is then placed, front side up, on movable template 308 of sewer 300. At this time the reversed "L"-shaped box pattern is applied in a single process. This process is the heart of the operation, and is detailed below with respect to the operator positioned at the needle end of sewer 300.

Referring still to FIG. 7, once the shirt is in place with the base of the placket set generally beneath box pressure foot 306 (a sample piece of material is shown as 332), the operator begins the cycle by pressing pedal 402 (see FIG. 9), and the pattern sewing cycle commences.

Pressure so applied activates first the slave pressure foot 314 (see FIG. 7) to press downward upon the article to be sewn. Next, start cylinder 428 see FIG. 9) engages channeled flywheel 326 (see FIG. 8), and the cycle proceeds and accomplishes the following maneuver in a few seconds.

Box pressure foot 306 (see FIG. 7) presses downward upon the article being sewn, and the needle 303 begins sewing within the inner opening of box pressure foot 306. By selective movement of movable assembly 334, a box-shaped pattern is accomplished within the inner opening of box pressure foot 306. As the movable assembly 334 progresses in a right-to-left motion relative to the operator, needle 303 "leaves" box pressure foot 306 via slot 390. The needle then seams along straight pressure foot 312 (which was activated to press downward upon the article during the inner box sewing step) as movable template 308 continues to proceed in its right-to-left motion.

When needle 303 has reached the approximate end of straight foot 312, movable assembly 334 hesitates for a few seconds to allow for the thread to be cut by thread cutter 329 (see FIG. 8). This hesitation is caused by three-way control valve 417.

After the cutting maneuver is completed, movable assembly 334 is returned to its starting position by shift cylinder 412 and the cycle is ready to begin again.

The ninth step of the process includes closing the sides of the shirt and adding thereto by conventional means sleeves, pockets, etc.

The finished reversed "L"-shaped pattern is illustrated in FIG. 1 on completed shirt 4 as pattern 6. The reverse L-shaped box pattern is defined by sides 7, 8, 9. The reverse L-shape is made by sew lines 7, 8. Side 9 "completes" the box shaped pattern.

The present invention is not restricted to the particular structure and examples described above and illustrated in the attached drawings. Various modifications and variations can be made in the described structure by those skilled in the art without exceeding the scope of the invention as claimed hereinbelow.

We claim:

1. A system for joining and finishing two overlapping strips of limp fabric which, when joined and finished, form a semi-finished garment placket and attaching said placket to an unfinished garment for finishing said garment, comprising:
   - folder for folding a pair of edges of said overlapping strips of fabric along predetermined fold lines;
   - fuser means for fusing said strips and said folded edges together; and
   - sewer means for sewing the folded and fused strips of fabric on the prepared garment with a predetermined sewing pattern.

2. A system according to claim 1, wherein:
   - said sewing on the prepared garment forms a reversed "L"-shaped box.

3. A system according to claim 1, wherein said folder means comprises:
   - a support assembly;
   - a drive belt assembly fitted to said support assembly; and
   - a folder assembly generally interconnected between said support assembly and said drive belt assembly.

4. A system according to claim 1, wherein said fuser means comprises:
   - a base portion;
   - a placket guide belt fitted to said base portion;
   - a fuser portion mounted on said base portion and having said guide belt operatively interconnected therein; and
   - a cover portion fitted above said fuser portion.

5. A system for joining and finishing two overlapping strips of limp fabric which, when joined and finished, form a semifinished garment placket and attaching said placket to an unfinished garment for finishing said garment, comprising:
   - a folder for folding a pair of said overlapping strips of fabric along predetermined fold lines;
   - a fuser means for fusing said strips and said folded edges together; and
   - sewer means for sewing comprising:
   - a sewing means for sewing;
   - a central support plate upon which said sewing means is fitted;
   - a base board upon which said support plate rests;
   - a channeled flywheel operatively fitted to said support plate and said sewing means;
   - a fixed plate fitted to said sewing means;

a movable assembly means movably fitted to said sewing means for receiving and securing said placket;

a thread cutter fixed to said central support plate and operatively interconnected with said movable assembly means;

a plurality of control arms pivotally fitted at one end to said movable assembly means and cooperating at their opposite ends with said channeled flywheel;

a fluid control system operatively interconnected with said movable assembly means and said thread cutter; and a fluid disposed within said fluid control system.

6. A system according to claim 5, wherein said movable assembly means comprises:

a main support arm;

a movable template fitted to the lower portion of said support arms;

a plurality of cylinder units fitted to the upper portion of said main support arm; and a plurality of pressure feet operatively fitted to said cylinder units.

7. A system according to claim 5, wherein said fluid control system comprises:

a plurality of control valves for selectively determining fluid flow;

a plurality of cylinder units interconnected with said control valves for selectively operating pressure feet and a thread cutter;

a foot control pedal interconnected with said control valves and said cylinder units;

a central control valve operatively interconnected with said foot control pedal; and a plurality of fluid lines interconnecting said control valves, said cylinder units, said thread cutter, said foot control pedal and said central control valve.

8. A system according to claim 5, wherein:

said fluid is air.

9. A system according to claim 6, wherein said plurality of pressure feet comprise:

a box pressure foot;

a straight pressure foot; and a slave pressure foot;

said pressure feet being operatively and functionally interconnected.

10. An apparatus for sewing the pattern required for attaching and finishing a semi-finished placket to an unfinished garment comprising:

a sewing means for sewing;

a central support plate upon which said sewing means is fitted;

a baseboard upon which said support plate rests;

a channeled flywheel operatively fitted to said support plate and said sewing means for driving sewing operations;

a fixed plate fitted to said sewing means;

a movable assembly means movably fitted to said sewing means for receiving and securing said semi-finished placket and said unfinished garment, in combination;

a thread-cutter fitted to said central support plate and operatively interconnected with said movable assembly means;

a plurality of control arms pivotally fitted at one end to said movable assembly means and cooperating at their opposite ends with said channeled flywheel;

a fluid control system operatively interconnected with said movable assembly means and said thread cutter; and a fluid disposed within said fluid control system.

11. An apparatus according to claim 10, wherein:

said requisite pattern is reversed "L"-shaped box.

12. An apparatus according to claim 10, wherein said movable assembly comprises:

a main support arm;

a movable plate fitted to the lower portion of said support arm;

a plurality of cylinder units fitted to the upper portion of said main support arms; and a plurality of pressure feet operatively fitted to said cylinder units.

13. An apparatus according to claim 10, wherein said fluid control system comprises:

a plurality of control valves for selectively determining fluid flow;

a plurality of cylinder units interconnected with said control valves for selectively operating said pressure feet and said thread cutter;

a foot control pedal interconnected with said control valves and said cylinder units;

a central control valve operatively interconnected with said foot control pedal; and a plurality of fluid lines interconnecting said control valves, said cylinder units, said thread cutter, said foot control pedal and said central control valve.

14. An apparatus according to claim 10, wherein:

said fluid is air.

15. An apparatus according to claim 12, wherein said plurality of pressure feet comprise:

a box pressure foot;

a straight pressure foot; and a slave pressure foot;

said pressure feet being operatively and functionally interconnected.

16. A system according to claim 1, wherein:

one of said two overlapping strips of limp fabric is lining lining having die-cut thereon means for indicating positions for folding, setting points and sewing and cutting stopping points comprising a plurality of holes, notches and fold slits.

17. An apparatus according to claim 10, wherein:

one of said two overlapping strips of limp fabric is lining lining having die-cut thereon means for indicating positions for folding, setting points and sewing and cutting stopping points comprising a plurality of holes, notches and fold slits.

18. A system according to claim 10, wherein:

said fluid is a liquid.

* * * * *

UNITED STATES PATENT AND TRADEMARK OFFICE

CERTIFICATE OF CORRECTION

PATENT NO. : 4,850,292

DATED : July 25, 1989

INVENTOR(S) : Michael Levy et al.

It is certified that error appears in the above-identified patent and that said Letters Patent is hereby corrected as shown below:

Column 4, line 5, change the comma to --and--.
Column 5, line 13, after "sults" insert --in--.
Column 8, line 27 (claim 1, line 6), after "folder" insert --means--.
Column 9, line 18 (claim 6, line 5), change "arms" to --arm--.
Column 10, line 14 (claim 11, line 2), after "is" insert --a--;
Column 10, line 21 (claim 12, line 7), change "arms" to --arm--;
Column 10, line 55 (claim 17, line 3), delete "lining" (one occurrence).

Signed and Sealed this

Thirtieth Day of April, 1991

*Attest:*

*Attesting Officer*

HARRY F. MANBECK, JR.

*Commissioner of Patents and Trademarks*